United States Patent [19]

Hermann

[11] Patent Number: 4,947,567

[45] Date of Patent: Aug. 14, 1990

[54] LABEL TAPE

[76] Inventor: Klaus-Dieter Hermann, Ritterweg 17, D-6932 Hirschhorn, Fed. Rep. of Germany

[21] Appl. No.: 302,432

[22] Filed: Jan. 27, 1989

[30] Foreign Application Priority Data

Jan. 27, 1988 [DE] Fed. Rep. of Germany ..... 3802341

[51] Int. Cl.[5] ..... G09F 3/03

[52] U.S. Cl. ..... 40/299; 40/638

[58] Field of Search ..... 40/299, 630, 638, 595

[56] References Cited

U.S. PATENT DOCUMENTS 3,221,427 12/1965 Kaplan .

FOREIGN PATENT DOCUMENTS 1217769 5/1963 Fed. Rep. of Germany .
1761575 6/1968 Fed. Rep. of Germany .
3619466 12/1987 Fed. Rep. of Germany ..... 40/299
2597640 10/1987 France ..... 40/299
2194932 3/1988 United Kingdom ..... 40/299

*Primary Examiner*—Laurie K. Cranmer
*Attorney, Agent, or Firm*—Powell L. Sprunger

[57] ABSTRACT

A label tape having self-adhesive labels sticking on a carrier strip, with said labels being separated from each other by cuts running mainly transverse to the longitudinal axis of the label tape and being subdivided each into sections by at least two cutting lines in form of periodic curves running in longitudinal direction to the label tape. The height of the labels is greater than and aliquant to the periodic length of the cutting lines, the form of the cutting lines is chosen such that parts of the cutting lines confine an angle of not more than 90° and the curves of the cutting lines of the label tape are staggered in a longitudinal direction. The height of the label measured in longitudinal direction of the label tape differs from the periodic length of the cutting lines and of a morefold thereof, and the periodic length of the cutting lines is lower than the height of a label. Thus, security against forgery by the invention is improved.

5 Claims, 1 Drawing Sheet

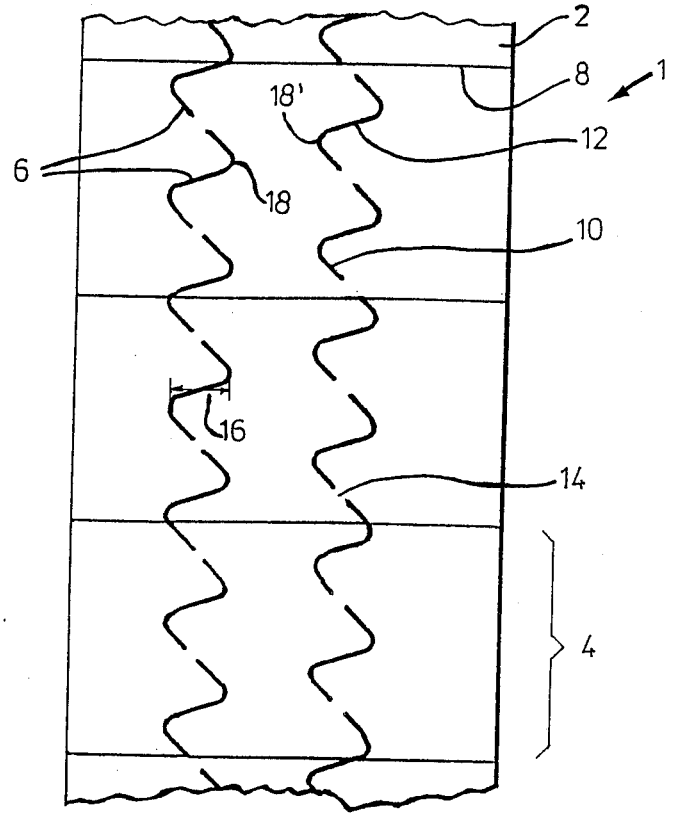
2
8
1
18'
12
6
18
10
16
14
4

LABEL TAPE

The present application claims priority of application No. P 38 02 341.5, filed in the Federal Republic of Germany on Jan. 27, 1988, incorporated herein by reference.

BACKGROUND OF THE INVENTION

The present invention relates to a label tape comprising self-adhesive labels sticking on a carrier strip which are separated from each other by cuts running mainly transverse to the longitudinal direction of the label tape and which are subdivided into sections by at least two cutting lines running in longitudinal direction of the label tape and forming periodic curves, with said sections being linked to each other in embodiments of the invention by bridges formed by gaps in the cutting lines These label tapes serve for sticking the single labels by means of suitable devices onto products to be sold for example. The periodic curves divide each label into at least three sections which are easily separated from each other when somebody tries to remove a single label from the product it sticks on, so that an unauthorized transfer of a label from one product to another becomes difficult. U. S. Pat. No. 3,221,427 discloses "self-destructive" adhesive tapes comprising two uninterrupted periodic cutting lines running mainly in longitudinal and partly in transverse direction of the label tape, their curvature confining angles of less than 90°. However, these tapes are not divided into label sections.

In the DE-AS 1 217 769, for example, the periodic curves are not formed as uninterrupted cutting lines but show relatively small disruptions so that paper bridges remain keeping the sections together and allow the label to be cleared, say removed and stuck somewhere else by means of a suitable device in which the label is separated from the carrier strip in which the cutting lines do not reach. However, this publication discloses only one periodic curve for one label tape. The cutting lines can also be formed without disruption, connections between the label sections being provided by glue bridges when the labels are being removed.

In label tapes according to DE-OS 1 761 575 the periodic curves are formed wave-like similar to sine curves which run transverse to the longitudinal axis of the label tape and have a maximum amplitude of respectively only about 8% of the width of a single label measured in transverse direction of the tape and thus are relatively flat. In these known tapes the curves formed by the cutting lines run totally parallel to each other and the patterns of the cutting lines in longitudinal direction of the label tape recur every fourth label. Therefore, it is still possible that a section of a label stuck onto a product is removed without authorization and fitted into another label and that this deception is hardly recognizable.

It is an object of the present invention to ensure that said labels can hardly be falsified. This is achieved by choosing the height of a label measured in longitudinal direction of the tape aliquant to the period length of the cutting lines by choosing the form of the curves of the cutting lines such that parts of the cutting lines confine an angle of not more than 90°, and that the curves of the different cutting lines are staggered in longitudinal direction of the label tape.

It is an advantage of the invention that since the division of the periodic cutting lines and the cuts separating one label from another differs and in particular is aliquant, there are many labels between labels having exactly the same cutting lines. Especially when the cutting lines have parts running nearly transverse to the longitudinal axis of the label tape it can be easily detected when efforts were made to assemble a new label from parts of labels not belonging together, in particular when the label is stuck on an article whose color is quite different than that of the label, even when the form of the cutting lines of adjacent labels on the label tape differs only slightly. Since the height of the labels is greater than the periodic length of the cutting lines, preferably at least by a factor of 1,5, but not greater than the tenfold periodic length, a forgery is easily detected when label sections do not exactly fit together.

A further advantage of the invention is that a label section which is limited on both sides by staggered curved cutting lines has an irregular, bizarre form which furthermore aggravates the unauthorized exchange of label sections. Even an exactly fitting section can hardly be put into an applied label without trouble.

When applying the single labels of known label tapes by means of a labelling device it is possible that the single sections of the label are disconnected if the paper bridges are not strong enough. However, if the paper bridges are too strong the risk increases that the entire label might be removed from a labelled object without authorization and stuck onto another object.

Another advantage is that the periodic cutting lines, in general only two, do not run parallel to each other and thus the stability of the label when applying it by means of conventional devices is improved. Therefore, it is possible to keep the paper bridges relatively small (in relation to the length of the cutting lines) and nevertheless the label can be stuck onto a product without being damaged.

An embodiment of the invention has the advantage that forgery can be further prevented in particular when parts of the cutting lines confine a relatively large angle with the longitudinal axis of the label tape and thus with the direction of feeding from the labelling device.

Another embodiment of the invention has the advantage that the cutting lines have fields that are arranged having very different angles so that when the tape is removed without authorization it will almost certainly tear independently from the direction of removal.

An embodiment of the invention has the advantage that the tearing of a label into single sections when removed without authorization is furthermore favored because of the relatively long distance a single cutting line is running in longitudinal direction of the label tape by zigzagging. In particular, when the label is being torn into its single pieces, vertical parts of the applied inscription, especially prices are being subdivided into single parts, so that it is difficult to reassemble them to a new label out of parts not belonging together.

Further features and advantages of the invention are described in the following specification of an embodiment of the invention and the drawing, that shows important details of the invention and the claims. The single features can be realized in an embodiment of the invention individually or in any combination.

The single FIGURE is a front plan view of a section of a label tape of the present invention in which three adjacent labels are arranged.

Referring to the FIGURE, a label tape generally designated 1 of the present invention has a carrier strip 2 on which labels 4 are arranged one adjacent to the next. The labels 4 have an adhesive glue layer on their backside which clings easily removable to the carrier strip 2, and is later on to be stuck onto the surface that shall be labelled. The labels 4 are formed starting from a tape with a continuous paper web sticking on the carrier strip 2, which, in a first punching tool is provided with curve-shaped cutting lines 6, in the FIGURE mainly running from the top downwards, and in a second punching process is provided with cuts 8 running transverse to the longitudinal direction of the tape, in the example straight cutting lines forming the single labels. The cutting lines 6 have a saw-toothed shape with a section 10 confining an angle of about 45° with the longitudinal direction of the label tape and a section 12 confining an angle of about 70° . These sections run mainly straight. The borders between the sections 10 and 12 are slightly rounded.

Each of the sections 10 has a paper bridge 14 formed by a gap in the punching tool.

In the present embodiment of the invention a single label 4 has a width of 37 mm and a height of 19 mm. The label height measures slightly more than two full periods of the curve-shaped cutting lines 6. The paper bridges 14 have a length of about 1,0 mm.

The width 16 of each cutting line 6 transverse to the longitudinal direction of the label tape 1 measures in the example about 5,5 mm, thus about 26% of the height of a label 4 measured in longitudinal direction of the tape and about 15% of the label width.

The two identic periodic cutting lines 6 are staggered in longitudinal direction of the label tape so that any top 18 or 18' pointing to the opposite cutting line faces a section extending along the respective opposite cutting line 6 in vicinity to this top 18 or 18' respectively, with said section confining an angle of about 45° with the longitudinal direction.

In other embodiments of the invention both cutting lines differ from each other in their form and/or period length. When the period length differs the constellation of the cutting lines relative to each other will change permanently.

The foregoing detailed description is given for clearness of understanding only, and no unnecessary limitations should be understood therefrom, as modifications will be obvious to those skilled in the art.

What is claimed is:

1. A label tape comprising, self-adhesive labels sticking on a carrier strip, said labels being separated from each other by cuts running mainly transverse to a longitudinal axis of the label tape and being subdivided each into sections by at least two cutting lines in form of periodic curves running in a longitudinal direction of the label tape, and having spaced peaks wherein the height of the labels measured in longitudinal direction of the label tape is greater than the periodic length of the cutting lines, with the height of a label being aliquant to the periodic length of the cutting lines, with the form of the cutting lines being chosen such that parts of the cutting lines confine an angle of not more than 90 degrees, with the curves of the cutting lines of the label tape being staggered in longitudinal direction, and with the curve of one cutting line differing from the curve of the other cutting line along the length of the labels such that peaks of each cutting line face towards the other cutting line at locations spaced from the peaks of the other cutting line.

2. The label tape according to claim 1 wherein the curves are asymmetric with respect to an axis running transverse to the longitudinal axis of the label tape.

3. The label tape according to claim 2 wherein the curves run in saw-tooth form.

4. The label tape according to claim 1 wherein the curves have parts tilted by about 45° with respect to the longitudinal axis of the label tape and other parts tilted by about 70° or more.

5. The label tape according to claim 1 wherein the curves each cover about 10% of the width of the label tape in transverse direction of the longitudinal axis of the label tape, and preferably about 15%.

* * * * *